US007793572B2

(12) United States Patent
Hirt et al.

(10) Patent No.: US 7,793,572 B2
(45) Date of Patent: Sep. 14, 2010

(54) ATTACHMENT FOR A POWER TOOL

(75) Inventors: Daniel Hirt, Kirchentellinsfurt (DE); Juergen Gairing, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 60 days.

(21) Appl. No.: 11/945,796

(22) Filed: Nov. 27, 2007

(65) Prior Publication Data

US 2008/0136125 A1 Jun. 12, 2008

(30) Foreign Application Priority Data

Dec. 8, 2006 (DE) ..... 10 2006 057 928

(51) Int. Cl.
*B25B 23/157* (2006.01)
*B25G 3/12* (2006.01)

(52) U.S. Cl. ..... 81/473; 279/103

(58) Field of Classification Search ..... 81/473, 81/467, 429; 173/178; 279/103
See application file for complete search history.

(56) References Cited

U.S. PATENT DOCUMENTS

| | | | | |
|---|---|---|---|---|
| 4,243,129 | A * | 1/1981 | Schoeps | 192/56.2 |
| 4,824,298 | A * | 4/1989 | Lippacher et al. | 408/240 |
| 5,342,154 | A * | 8/1994 | Holzer | 408/240 |
| 5,738,469 | A * | 4/1998 | Hsu | 408/139 |
| 5,951,026 | A * | 9/1999 | Harman et al. | 279/143 |
| 5,954,463 | A | 9/1999 | Jore | |
| 6,045,303 | A * | 4/2000 | Chung | 408/124 |
| 6,079,716 | A * | 6/2000 | Harman et al. | 279/75 |
| 6,142,242 | A * | 11/2000 | Okumura et al. | 173/48 |
| 6,293,559 | B1 * | 9/2001 | Harman et al. | 279/75 |
| 6,550,786 | B2 * | 4/2003 | Gifford et al. | 279/75 |
| 6,551,037 | B2 * | 4/2003 | Gifford et al. | 408/239 R |
| 6,688,611 | B2 * | 2/2004 | Gifford et al. | 279/71 |
| 7,021,399 | B2 * | 4/2006 | Driessen | 173/29 |
| 7,219,583 | B1 * | 5/2007 | Chen | 81/467 |
| 7,281,459 | B2 * | 10/2007 | Zhang et al. | 81/475 |
| 2005/0274230 | A1 | 12/2005 | Lin | |
| 2006/0118380 | A1 | 6/2006 | Aeberhard | |
| 2006/0201282 | A1 | 9/2006 | Lee | |
| 2007/0209814 | A1 * | 9/2007 | Furusawa et al. | 173/48 |
| 2007/0227315 | A1 * | 10/2007 | Provost | 81/467 |

FOREIGN PATENT DOCUMENTS

| | | |
|---|---|---|
| DE | 10 2004 058 807 | 6/2006 |
| DE | 20 2006 003 110 | 7/2006 |
| EP | 1 236 538 | 9/2002 |
| EP | 1 724 068 | 11/2006 |
| GB | 1 429 959 | 3/1976 |
| GB | 2 173 729 | 10/1986 |
| GB | 2 372 471 | 8/2002 |

* cited by examiner

*Primary Examiner*—David B Thomas
(74) *Attorney, Agent, or Firm*—Michael J. Striker

(57) ABSTRACT

An attachment for a power tool has a tool receptacle for receiving a tool bit, a locking unit which is detachably mountable on a housing of a power tool, an output shaft, which is connectable to a drive shaft of the power tool in a manner fixed against relative rotation, and a device for adjusting the torque.

13 Claims, 4 Drawing Sheets

ATTACHMENT FOR A POWER TOOL

CROSS-REFERENCE TO A RELATED APPLICATION

The invention described and claimed hereinbelow is also described in German Patent Application DE 10 2006 057 928.3 filed on Dec. 8, 2006. This German Patent Application, whose subject matter is incorporated here by reference, provides the basis for a claim of priority of invention under 35 U.S.C. 119(a)-(d).

BACKGROUND OF THE INVENTION

The invention relates to an attachment for a power tool.

To increase the usage possibilities for a power tool, such as a screwdriver or drill screwdriver, it is known from the prior art to mount an attachment detachably on the power tool. For the detachable mounting of an attachment on the housing of a power tool, various types of fastening are known. Conventional attachments are for instance firmly clamped to a clamping neck of the power tool or are clamped in the axial direction against the housing of a power tool by means of a bayonet mount.

From the prior art, angled attachments are for instance known, whose output shaft is at an angle to the drive shaft of the power tool. Eccentric attachments are also known, in which the output shaft is offset from but parallel to the drive shaft of the power tool. Once the attachment is mounted on the power tool, the output shaft of the attachment and the drive shaft of the power tool are in driving communication with one another, so that the drive shaft, via the output shaft, drives a tool bit, such as a screwdriver bit or drill bit, that is received in a tool receptacle of the attachment.

SUMMARY OF THE INVENTION

It is therefore an object of the present invention to provide an attachment for a power tool, which is a further improvement of the known attachments.

The invention is based on an attachment which can be mounted detachably on a housing of a power tool by means of a locking unit. The attachment includes an output shaft, which can be connected to a drive shaft of the power tool in a manner fixed against relative rotation, and also includes a tool receptacle for receiving a tool bit, such as a screwdriver bit.

It is proposed that the attachment be equipped with a device for adjusting the torque. In particular, the torque adjusting device can be operated manually, without additional aids or tools. The torque adjusting device allows the user, at the attachment, to adjust the maximum torque suitable for the particular operation needed. Once the preset torque has been reached, the output shaft of the attachment is disconnected from the drive shaft.

For that purpose, the torque adjusting device has a overload coupling with two coupling halves; an input shaft of the attachment is equipped with a first coupling half, and an output shaft is equipped with a second coupling half.

At least one of the two coupling halves is acted upon by a spring force, and the spring force is adjustable. The spring force determines the torque that can be transmitted from input shaft to the output shaft. If the torque is too high, then the coupling halves and thus the tool receptacle of the attachment and the drive shaft of the power tool are disconnected from one another.

For adjusting the spring force, the torque adjusting device is provided with an adjusting element. The adjusting element can be actuated manually without further aids. The adjusting element is preferably a rotatably supported adjusting ring. The adjustment can be done in continuously variable fashion, or in stages.

For the overload coupling, various embodiments are possible. Examples of known overload couplings are a claw coupling or blocking body coupling with rollers or balls as the blocking bodies. In these overload couplings, when the torque preset via the coupling spring is reached, the coupling halves are pressed apart from one another by way of oblique claws, rollers, or balls.

In a preferred embodiment of the attachment of the invention, the overload coupling is a friction-locking coupling, in particular a slip coupling. The coupling halves are embodied in the form of louvered disks.

When the attachment is mounted on a housing of a power tool, the drive shaft of the power tool is brought into a torsionally fixed connection with the input shaft of the attachment. For that purpose, the drive shaft, on its free end, has a polygonal recess, for instance. Conversely, on the input shaft of the attachment, a corresponding polygonal extension is embodied that is received in form-locking fashion by the polygonal recess in the drive shaft. Upon attachment of the attachment, the drive shaft and the input shaft and can thus be put together in a manner fixed against relative rotation, without additional manual actuation. So that the power tool can also be used without the attachment, the polygonal face-end recess in the drive shaft is shaped in such a way that it can simultaneously function as a receptacle for a tool bit, such as a screwdriver bit.

For mounting the attachment on the power tool, various types of fastening are possible. From the prior art, the detachable fastening by means of a bayonet mount or a screw mount, for instance, is known. In a preferred embodiment of the attachment of the invention, the fastening is done by means of a detent connection. To that end, the locking unit of the attachment, with which the attachment can be mounted detachably on a housing of a power tool, includes at least one means for a detent connection, in particular an elastic detent connection. A detent connection has the advantage of being easy to manipulate, since no additional tool is required as an aid for mounting or detaching the attachment.

The ease of manipulation of the detent connection is especially apparent in an embodiment in which the at least one detent means is embodied as locking automatically, that is, without further actuation of the detent means or of some other means. This means that as soon as the attachment is axially placed against the housing of a power tool, the at least one detent means lockingly engages corresponding means, such as a recess, on the housing of the power tool. The detent connection between the attachment and the housing of the power tool becomes operative fully automatically, that is, without needing any other gesture or any other aid (autolock function). This can be accomplished for instance by a resilient detent connection, such that a resilient detent means, in the joining together of the attachment and the power tool, is brought by constrained guidance into engagement with a corresponding means on the housing of the power tool, such as a recess, counter to the force of the resilient detent means.

The detent means may be a separate component which is mounted on the locking unit of the attachment. However, it may also be embodied in one piece with the locking unit by being integrally formed onto the locking unit. If the locking unit is made from plastic, for instance, then it is possible for one or more detent means, for instance in the form of detent hooks, to be integrally formed onto the locking unit.

In one embodiment of the attachment of the invention, the at least one detent means is a spring element; that is, the detent means is intrinsically resilient. Preferably, the spring element is an annular spring that is received as a separate component in the locking unit.

The annular spring is embodied such that upon attachment of the attachment to a housing of a power tool, it can be brought automatically into engagement with an annular groove that is provided on the housing of the power tool. Once the annular spring has been brought into engagement with the annular groove, the attachment is blocked in the axial direction.

In one embodiment, a first end of the annular spring is located in fixed fashion in the locking unit, while a second end of the annular spring is located movably relative to the locking unit in the circumferential direction. If the second, freely movable end of the annular spring is moved in the circumferential direction away from the first, fixed end, the annular spring expands and becomes subject to tension. Once the tension is released, the free end returns to its outset position. This effect of the annular spring is exploited to accomplish an automatic snapping into place. In the outset position, that is, before the attachment is attached to the housing of a power tool, the annular spring is in the tensionless state. As the attachment is attached to the housing of the power tool, the annular spring is tensed without further manual actuation, in that by means of a protrusion on the housing of the power tool, for instance, the annular spring is expanded by constrained guidance. The tension of the annular spring is in part undone again once the annular spring is in engagement with the annular groove on the housing. The engagement of the annular spring in the annular groove brings about a secure form lock and prevents unintentional release of the attachment from the power tool in the axial direction.

For removing the attachment from the power tool, the user must expand the annular spring so that it becomes disengaged from the annular groove. The expanding of the annular spring can advantageously be done manually, without further aids or tools. In a preferred embodiment, the second, freely movable end of the annular spring is located for that purpose in a rotatably supported unlocking ring of the locking unit. The locking unit includes a base body, which is provided with fixed engagement means for torsion-proof engagement with the housing of the power tool. On the base body, the annular spring is mounted by its first, fixed end. The second, free end is supported movably relative to the base body in the circumferential direction and is received freely movably in the unlocking ring. For receiving the free end of the annular spring in the unlocking ring freely movably, a freewheel is embodied in the unlocking ring, in the form of an oblong slot curved parallel to the circumferential direction.

The unlocking ring is rotatably supported on the base body in the circumferential direction, and the rotatability between an outset position and a terminal position is defined by one stop for each position. In the outset position of the unlocking ring, the annular spring is in the tensionless state, before the attachment is attached to the housing of the power tool. Upon attachment, the annular spring is automatically tensed by becoming expanded, and the free end of the annular spring is movable in the freewheel of the unlocking ring. Because of the freewheel for the free end of the annular spring, the unlocking ring need not be moved, either automatically or by the user. If the annular spring snaps into the annular groove, the unlocking ring continues to be in the outset position.

For removing the attachment, only a simple rotary motion of the unlocking ring relative to the base body is needed; at maximum, the unlocking ring can be moved as far as its terminal position, which is defined by a stop embodied on the base body. The free end of the annular spring is received in the unlocking ring in such a way that the unlocking ring, as a result of the rotary motion, carries the free end of the annular spring along with it. In the process, the annular spring is widened, counter to its spring force, until the annular spring becomes disengaged from the annular groove and can be removed from the housing of the power tool.

The at least one detent means brings about at least an axial securing of the attachment on a housing of a power tool. Thus the attachment is retained at least in the axial direction by the detent means. For absorbing the forces acting on the attachment in the circumferential direction, various means may be provided. For instance, an axially acting detent means may be embodied in such a way that it simultaneously acts as a torsion preventer. On the other hand, the torsion securing can be accomplished by a separate means instead. In one embodiment of the attachment of the invention, the locking unit has engagement means for torsion-proof engagement with a housing of a power tool. For that purpose, corresponding engagement means are provided on the housing.

The engagement means associated with one another are located in fixed fashion on the locking unit of the attachment and on the housing of the power tool. The engagement means are designed in particular in such a way that as soon as the attachment has been axially attached to the housing, the engagement means of the attachment and the housing enter into engagement with one another without any other manual actuation. As a result, as the attachment is being attached, a form-locking connection operative in the circumferential direction can be made. In this embodiment of the attachment, the forces acting in the circumferential direction are transmitted by the engagement means to the housing of the power tool, while the axially acting forces are transmitted by the detent means. Thus the forces acting in the circumferential direction and in the axial direction are absorbed by different means.

Preferably, the engagement means both on the locking unit and on the housing of the power tool are embodied as toothed rings. If the toothing of the toothed ring is appropriately fine, then the attachment can be mounted in practically any arbitrary angular position relative to the housing of the power tool.

A further subject of the invention is a power tool which includes an attachment of the invention. The power tool may be a battery-operated or plug-in screwdriver, drill, drill screwdriver, or the like.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
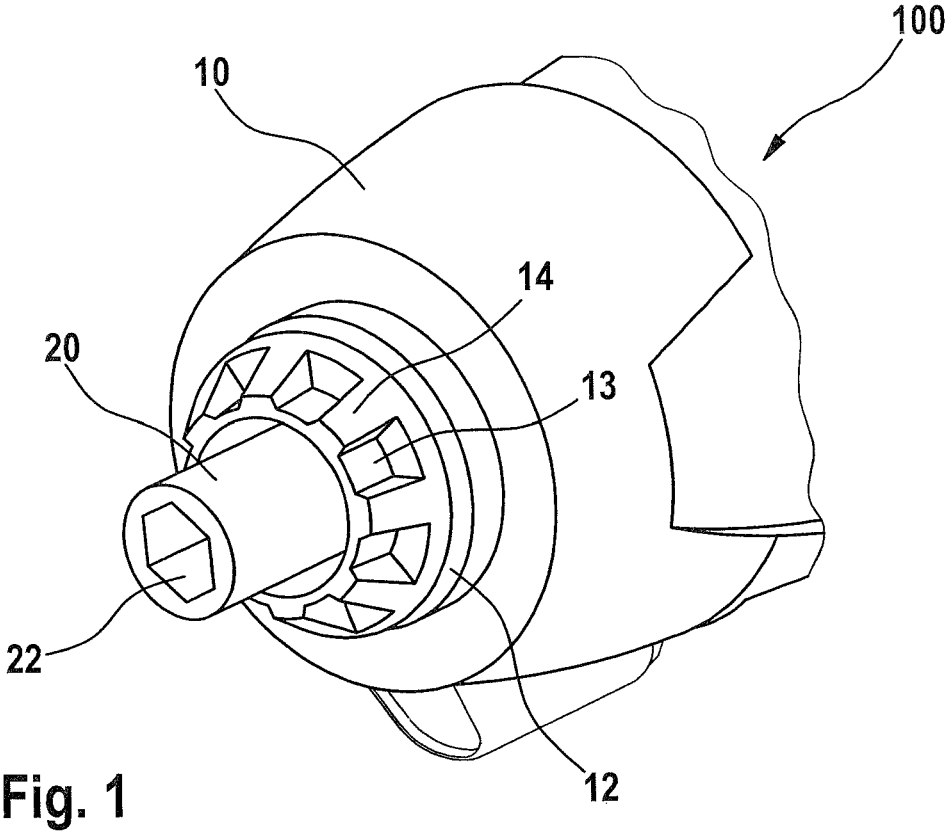
FIG. 1 shows a detail of a power tool with a drive shaft and a tool receptacle, in perspective.

In FIG. 1, a detail is shown of a power tool 100 that is suitable for receiving an attachment 30 (FIG. 2) of the invention. The power tool 100 shown in FIG. 1 is a screwdriver. In FIG. 1, only those parts of the power tool necessary for explaining the invention are shown. In its front region, in terms of the working direction, the power tool 100 includes a housing 10, from which a drive shaft 20 emerges. The drive shaft 20, on its face end, has a polygonal recess 22 for receiving a tool bit, such as a screwdriver bit (not shown). The power tool 100 may be operated as is, that is, without the attachment. To that end, a screwdriver bit, for instance, can be introduced as a tool bit into the recess 22.

Figure 2:
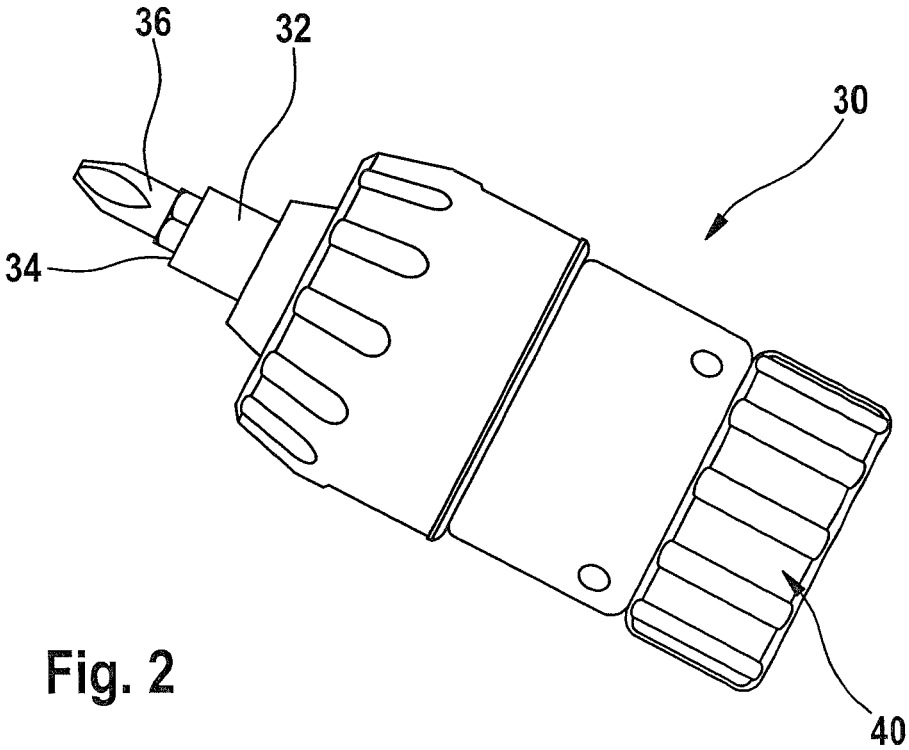
FIG. 2 is a side view of one embodiment of an attachment according to the invention, with an output shaft and a tool receptacle as well as a locking unit.

In the side view of FIG. 2, an attachment 30 of the invention for adjusting the torque is shown. The attachment 30 includes an output shaft 32, which on the output side on its face end has a recess 34 for receiving a tool bit 36, such as a screwdriver bit.

Figure 3:
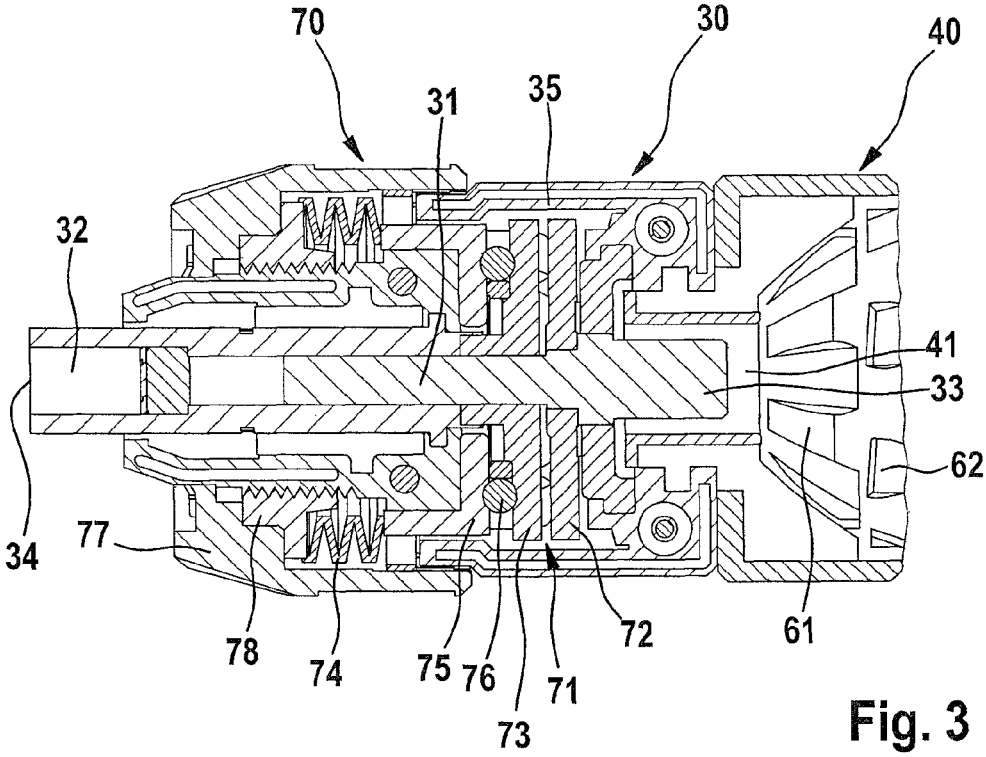
FIG. 3 shows a first embodiment of a torque attachment according to the invention.
Figure 4:
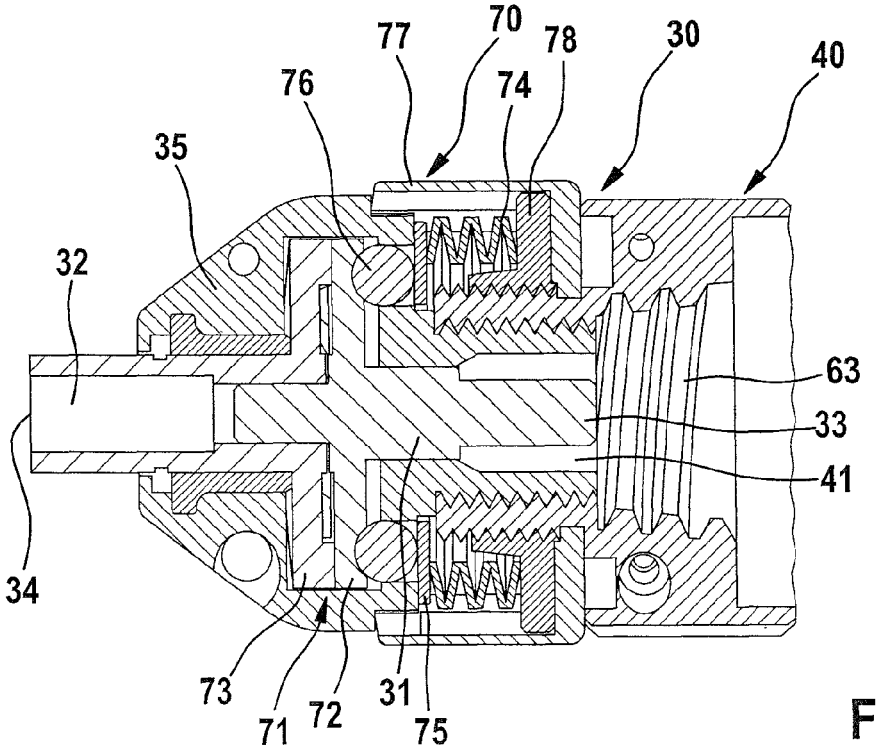
FIG. 4 shows a second embodiment of a torque attachment according to the invention.
Figure 5:
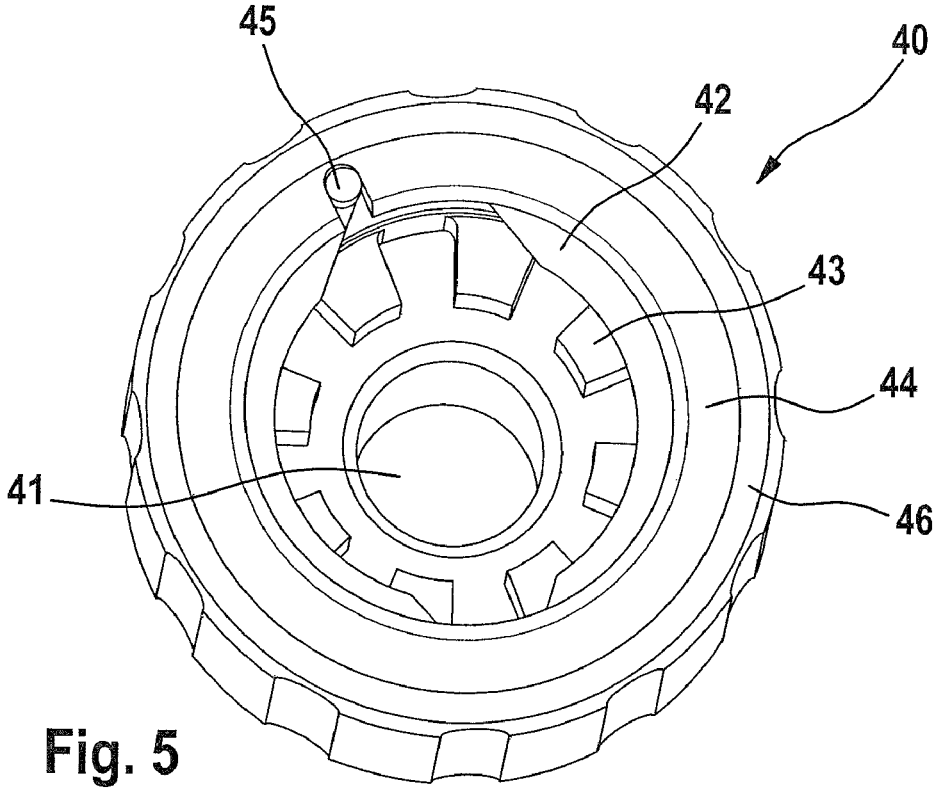
FIG. 5 shows an embodiment of a locking unit, comprising a base body, detent means, and unlocking ring, in a rear view.

In FIGS. 3 and 4, a first and second embodiment of an attachment 30 of the invention are shown. The attachment 30 of FIG. 3 or FIG. 4 is made up of a housing 35, a locking unit 40, and a device 70 for adjusting the torque.

The torque adjusting device 70 includes a overload coupling 71, which in the embodiments shown in FIGS. 3 and 4 is a slip coupling. For that purpose, the input shaft 31 is provided with a first coupling half 72, and the output shaft 32 is provided with a second coupling half 73. The coupling halves 72, 73 are embodied in the form of louvered disks. To accomplish a coaxial guidance of the input shaft 31 and output shaft 32, the input shaft 31 is received with play in the output shaft 32. Alternatively, the output shaft could be received with play in the input shaft instead (not shown).

In the embodiment of FIG. 3, the second coupling half 73 is acted upon by a spring force with the aid of a spring element 74, in this case in the form of cup springs. Instead of cup springs, some other spring element may be used, such as a helical spring. The spring force of the spring element 74 is transmitted to the second coupling half 73 via a pressure disk 75 and a bearing 76. Unlike the embodiment shown in FIG. 3, an embodiment is shown in FIG. 4 in which the first coupling half 72 is acted upon by spring force with the aid of a spring element 74. Once again, the spring force is transmitted to the coupling half 72 by means of a pressure disk 75 and a bearing 76.

For adjusting the maximum torque, the spring force is embodied adjustably. To that end, the torque adjusting device 70 has an adjusting element 77, in the form of an outer adjusting ring. The adjusting element 77 is rotatably supported on the housing 35 and can be actuated manually from outside by the user. An inner adjusting ring 78 is likewise supported rotatably and in addition axially displaceably on the attachment housing 35. To that end, the inner adjusting ring 78 is provided with a thread, which engages a thread on the housing 35. By simply rotating the adjusting element 77, the inner adjusting ring 78 is displaced axially, and the spring force is thus varied. The spring force may be adjustable in a continuously variable way, or in stages. For adjustability in stages, the inner adjusting ring may for instance be provided with detent grooves that are engaged lockingly by a detent spring (not shown). When the adjusting element 77 is rotated, the detent spring snaps audibly into the detent grooves.

Once the attachment 30 is mounted on the power tool 100, the input shaft 31 is in driving connection on the input side with the drive shaft 20 of the power tool 100. The driving connection, in a simple embodiment, may be attained for instance by a form lock, by providing that the drive shaft 20, as shown in FIG. 1, has a polygonal face-end recess 22, and the input shaft 31 of the attachment 30 is provided on the input side with an extension 33, of polygonal cross section, that is complementary to the face-end recess 22. As the attachment 30 and power tool 100 are being joined together, the extension 33 of the input shaft 31 is simply inserted, without further action, into the recess 22 in the drive shaft 20.

The attachment 30 furthermore includes a locking unit 40 for detachably mounting it on a housing 10 of a power tool 100. In FIG. 3, a locking unit 40 is indicated that establishes a bayonet connection between the attachment and the power tool. The engagement means 61 cooperate with corresponding engagement means (not shown) on a housing of a power tool in such a way that a form-locking, torsion-proof connection is made. In addition, engagement means 62 are provided on the locking unit 40; by a simple rotary motion, they enter into engagement with corresponding engagement means (not shown) on a housing of a power tool and thus make a bayonet mount for axially securing the attachment 30. In FIG. 4, a locking unit 40 is indicated that can be connected to a housing of a power tool via a conical thread 63.

A preferred embodiment of the attachment 30 is distinguished by a locking unit 40 which has at least one means 42 for an elastic detent connection. The locking unit 40 in the embodiment shown in FIGS. 5-8 is constructed from a base body 44, which has a central opening 41 for receiving the drive shaft 20 of the power tool 100. The base body 44 is provided with engagement means 43, which as the attachment 30 is being attached to the housing 10 permit torsion-proof engagement with corresponding engagement means 13 on the housing 10. The associated engagement means 43,13 are located in fixed fashion on the locking unit 40 of the attachment 30 and on the housing 10 of the power tool 100, respectively.

The engagement means 43,13 are designed such that as soon as the attachment 30 is axially placed against the housing 10, without other manual actuation, the engagement means 43,13 of the attachment 30 and of the housing 10 enter engagement with one another, thereby making a form-locking connection. The engagement means 43,13 transmit the forces, acting on the attachment 30 in the circumferential direction, to the housing 10. In the embodiment shown, the engagement means 43, 13 are embodied as toothed rings. The attachment 30 can therefore be mounted in practically any arbitrary angular position relative to the housing 10 of the power tool 100.

In the embodiment shown in FIGS. 5-8 of the locking unit 40 of an attachment 30 of the invention, the forces acting in the circumferential direction are transmitted by the engagement means 43, 13 to the housing 10 of the power tool 100, while the axially acting forces are transmitted by the detent means 42.

The detent means 42 here is a spring element in the form of an annular spring. The annular spring 42 is embodied such that as the attachment 30 is being attached to the housing 10, it automatically enters into engagement with an encompassing annular groove 12 on the housing. Once the annular spring 42 has snapped into the annular groove 12, the attachment 30 is blocked in the axial direction.

A first end 45 of the annular spring 42 is located in fixed fashion in the base body 44 of the locking unit 40, while a second end 47 of the annular spring 42 is movable in the circumferential direction relative to the base body 44 of the locking unit 40. If the second, freely movable end 47 of the annular spring 42 moves in the circumferential direction away from the first, fixed end 45, the annular spring 42 expands and becomes subject to tension. If the tension is released, the free end 47 returns to its outset position. The elasticity of the annular spring 42 is utilized to accomplish an automatic snapping into place. In the outset position, that is, before the attachment 30 is attached to the housing 10, the annular spring 42 is in the tensionless state. Upon attachment of the attachment 30 to the housing 10, the annular spring 42 is tensed without further manual actuation, because the annular spring 42 is subject to compulsory guidance along the housing 10. To facilitate the compulsory guidance of the annular spring 42 on the housing 10, the surfaces 14 of the teeth of the toothed ring 13 are beveled in the axial direction. Once the annular spring 42 enters into engagement with the annular groove 12 on the housing 10, the tension of the annular spring 42 is partly released again. The engagement of the annular spring 42 with the annular groove 12 brings about a secure form lock and prevents unintended release of the attachment 30 from the power tool 100 in the axial direction.

Thus for securing the attachment 30 on the housing 10 of the power tool 100, the user merely has to place the attachment 30 and the power tool 100 against one another in the axial direction in such a way that the engagement means 43, 13 mesh with one another. The detent means 42 snaps on its own into the corresponding means, that is, the annular groove 12, on the housing 10.

So that the annular spring 42 is capable of expanding when the attachment 30 is placed against the housing 10, the second end 47 of the annular spring 42 is located freely movably in the locking unit 40. It can be seen in FIGS. 7 and 8 that the second end 47 of the annular spring 42 protrudes freely movably into a recess 51 in the base body 44. As shown in the rear view of FIG. 5 and the front view of FIG. 6, the locking unit 40 further includes an unlocking ring 46, which is located on the base body 44. The rear view is understood to mean the view toward the side of the attachment that in the locked state is oriented toward the housing of the power tool, and the front view is understood to mean the view toward the side of the attachment that in the locked state faces away from the housing of the power tool.

Figure 6:
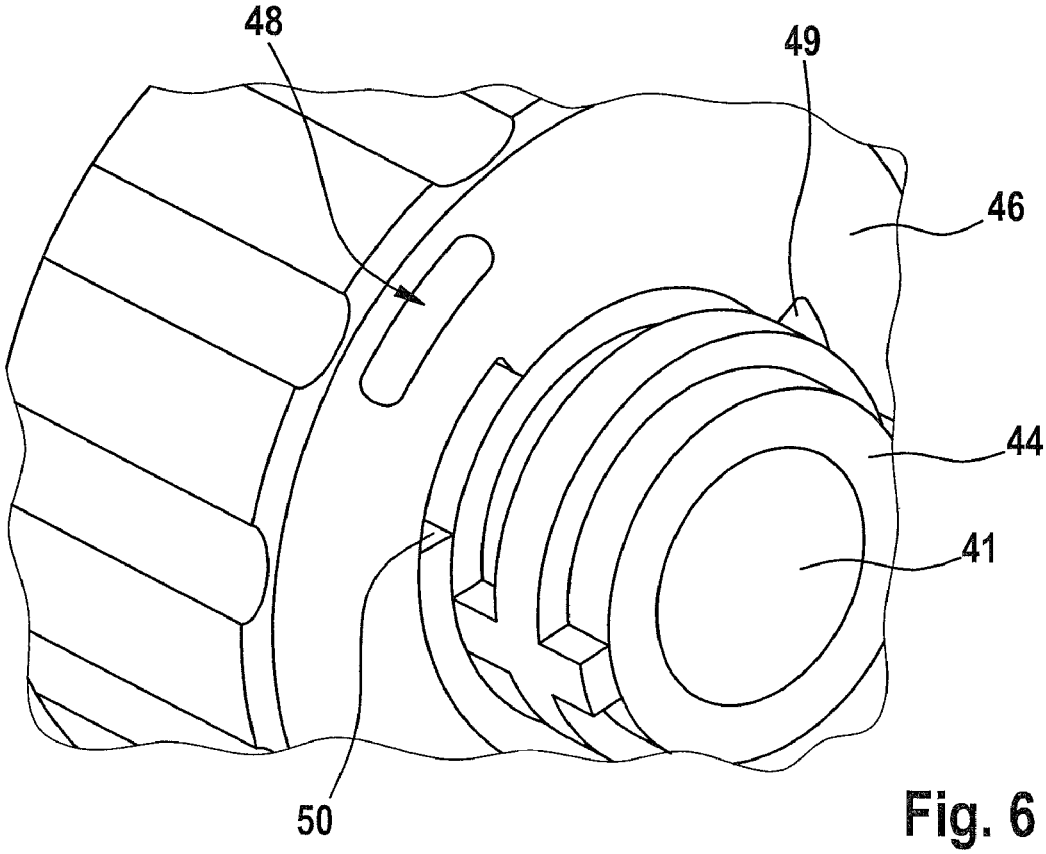
FIG. 6 shows the locking unit of FIG. 5, in a front view.
Figure 7:
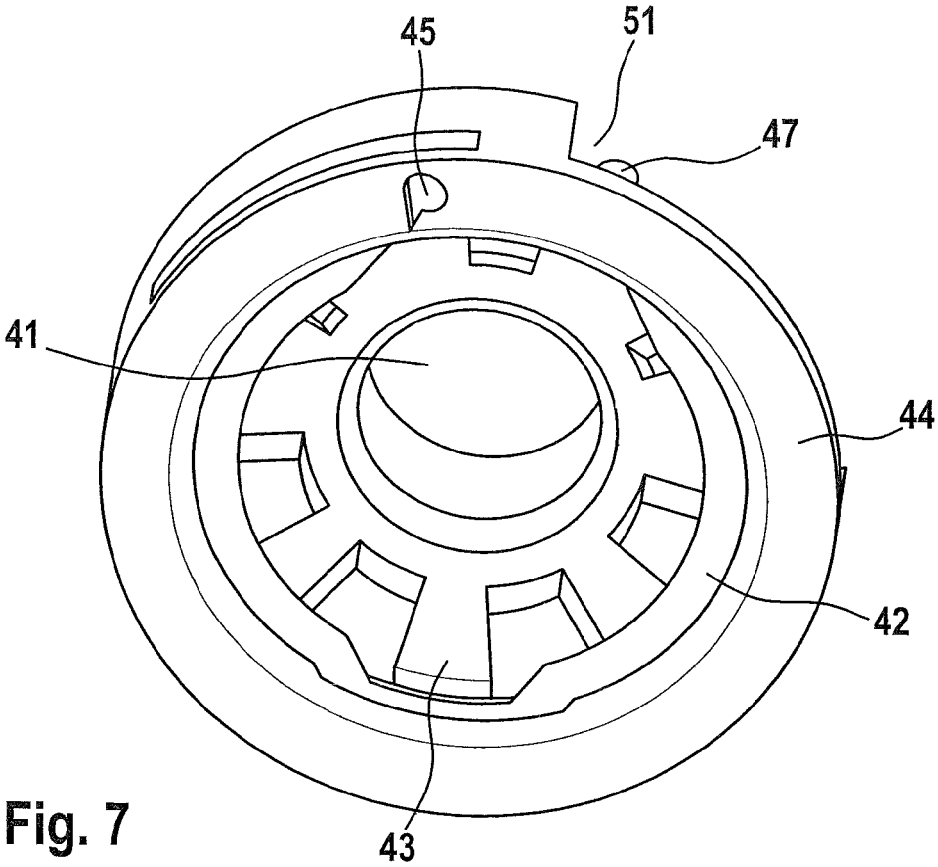
FIG. 7 shows the locking unit of FIG. 5 without the unlocking ring, in a rear view.

The second end 47 of the annular spring 42 is freely movable in the unlocking ring 46. To that end, as shown in FIG. 6, the unlocking ring 46 is provided with an axially continuous freewheel 48, in the form of an oblong slot curved parallel to the circumferential direction. The second end 47 of the annular spring 42 is supported freely movably in this freewheel 48. Upon attachment of the attachment 30 to the housing 10, the annular spring 42 can expand because the second end 47 can move freely in the freewheel 48. Because of the freewheel 48 for the free end 47 of the annular spring 42, the unlocking ring 46, as the attachment 30 is being attached, need not be moved, either automatically or by the user.

For removing the attachment 30 from the power tool 100, the annular spring 42 must be expanded, so that it becomes disengaged from the annular groove 12. The expansion of the annular spring 42 in turn takes place manually Without further aids or tools. For that purpose, the unlocking ring 46 is rotatably supported in the circumferential direction on the base body 44, and the rotatability, as shown in FIG. 6, between an outset position and a terminal position is limited by a respective stop 49, 50 on the base body 44. In the outset position of the unlocking ring 46, the annular spring 42 is in the tensionless state, before the attachment 30 is attached to the housing 10 of the power tool 100. If the annular spring 42, upon attachment to the housing 10, snaps into the annular groove 12, the unlocking ring 46 continues to be in its outset position.

Figure 8:
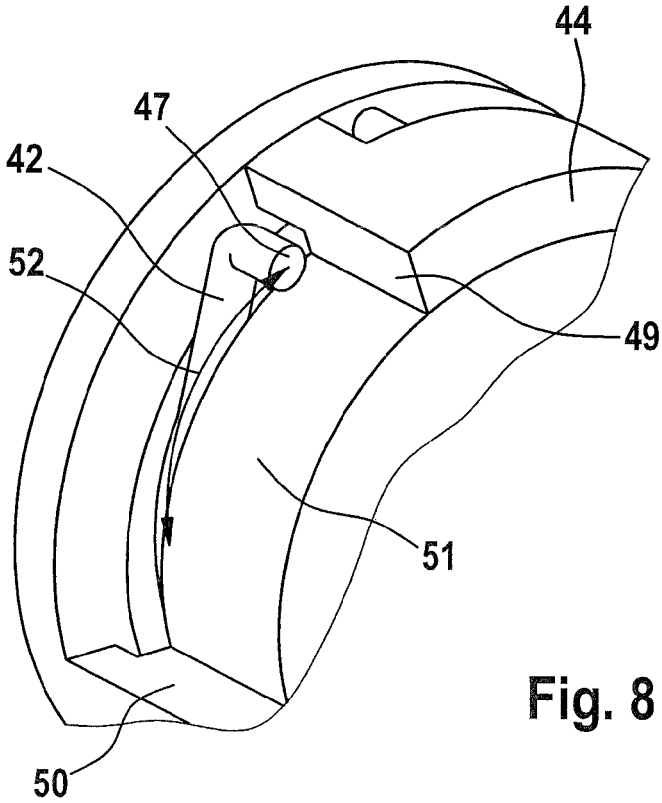
FIG. 8 shows the locking unit of FIG. 5 without the unlocking ring, in a front view.

For removing the attachment 30 from the power tool 100, only a simple manual rotary motion of the unlocking ring 46 relative to the fixed base body 44 is needed; at maximum, the unlocking ring 46 can be moved as far as its terminal position, which is defined by the stop 50 embodied on the base body 44. The free end 47 of the annular spring 42 is received in the unlocking ring 46 in such a way that the unlocking ring 46, as a result of the rotary motion, carries the free end 47 of the annular spring 42 with it. In the process, the annular spring 42 is expanded counter to its spring force, until the annular spring 42 becomes disengaged from the annular groove 12 and can be removed from the housing 10 of the power tool 100. In FIG. 8, for clarifying the motion of the free end 47 of the annular spring 42, only the base body 44 and the annular spring 42 are shown, along with a double arrow 52 that indicates the travel path of the end 47 of the annular spring 42.

After the attachment 30 is removed, the annular spring 42, by its spring force, presses the unlocking ring 46 back into its outset position, defined by the stop 49.

It will be understood that each of the elements described above, or two or more together, may also find a useful application in other types of constructions differing from the type described above.

While the invention has been illustrated and described as embodied in an attachment for a power tool, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An attachment for a power tool having a housing and a drive shaft, the attachment comprising: a housing; an output shaft with a tool receptacle for receiving a tool bit; a locking unit for detachably mounting the attachment to the housing of the power tool; an input shaft connectable to the drive shaft of the power tool in a manner fixed against relative rotation; and a device for adjusting a torque, wherein said locking unit, which is detachably mountable to said housing of the power tool, is manually operatable requiring no tool, and said locking unit has at least one means for a detent connection and an engagement means to permit torsion-proof engagement with corresponding engagement means on the housing of the power tool, thereby making a form-locking connection.

2. An attachment as defined in claim 1, wherein said torque adjusting device has an overload coupling.

3. An attachment as defined in claim 2, wherein said overload coupling of said torque adjusting device is a slip coupling.

4. An attachment as defined in claim 2, wherein said coupling has two coupling halves that are acted upon by a spring force.

5. An attachment as defined in claim 4, wherein said torque adjusting device has an adjusting element, with which said spring force is adjustable.

6. An attachment as defined in claim 5, wherein said adjusting element of said torque adjusting device is a rotatably supported adjusting ring.

7. An attachment as defined in claim 1, wherein said detent connection provided by said at least one means is configured as an elastic detent connection.

8. An attachment as defined in claim 1, wherein said at least one means for a detent connection is configured as automatically snappable into place.

9. An attachment as defined in claim 1, wherein said engagement means of said locking unit provide engagement, in a manner fixed against relative rotation, with the engagement means on the housing of the power tool.

10. An attachment for a power tool having a housing and a drive shaft, the attachment comprising: a housing; an output shaft with a tool receptacle for receiving a tool bit; a locking unit for detachably mounting the attachment to the housing of the power tool; an input shaft connectable to the drive shaft of the power tool in a manner fixed against relative rotation; and a device for adjusting a torque, wherein said locking unit, which is detachably mountable to said housing of the power tool is manually operatable requiring no tool, and said locking unit has at least one means for a detent connection, wherein said at least one detent means is configured as a spring element, and an engagement means to permit torsion-proof engagement with corresponding engagement means on the housing of the power tool, whereupon engagement of the spring element with the corresponding engagement means on the housing provides a secure form lock and prevents unintended release of the attachment from the power tool in an axial direction.

11. An attachment as defined in claim 10, wherein said spring element has a first end located in fixed fashion, and a second end located movably in a circumferential direction relative to said locking unit.

12. An attachment as defined in claim 11, wherein said locking unit has a rotatably supported unlocking ring, said second end of said spring element being located in said rotatably supported unlocking ring of said locking unit.

13. A power tool, comprising a housing; a drive shaft; a tool bit; and an attachment including a housing, an output shaft with a tool receptacle for receiving said tool bit, a locking unit detachably mountable to said housing of the power tool; an input shaft connectable to said drive shaft in a manner fixed against relative rotation; and, a device for adjusting a torque; wherein said locking unit, which is detachably mountable on said housing of the power tool, is manually operatable requiring no tool, and said locking unit has at least one means for a detent connection and an engagement means to permit torsion-proof engagement of the attachment with corresponding engagement means on the housing of the power tool, thereby making a form-locking connection.

* * * * *